US007707940B2

(12) United States Patent
Lebacher

(10) Patent No.: US 7,707,940 B2
(45) Date of Patent: May 4, 2010

(54) MULTIPLE PART MUNITION

(75) Inventor: Walter Lebacher, Aschau a. Inn (DE)

(73) Assignee: Nitrochemie Aschau GmbH, Aschau A. Inn (DE)

( * ) Notice: Subject to any disclaimer, the term of this patent is extended or adjusted under 35 U.S.C. 154(b) by 244 days.

(21) Appl. No.: 11/921,517

(22) PCT Filed: May 17, 2006

(86) PCT No.: PCT/EP2006/004648

§ 371 (c)(1),
(2), (4) Date: Dec. 4, 2007

(87) PCT Pub. No.: WO2006/131193

PCT Pub. Date: Dec. 14, 2006

(65) Prior Publication Data

US 2009/0205528 A1 Aug. 20, 2009

(30) Foreign Application Priority Data

Jun. 4, 2005 (DE) ..... 10 2005 025 714

(51) Int. Cl.
*F42B 5/02* (2006.01)

(52) U.S. Cl. ..... 102/434; 102/432; 102/433; 86/10; 86/18

(58) Field of Classification Search ..... 102/431, 102/432, 433, 434; 86/10, 18
See application file for complete search history.

(56) References Cited

U.S. PATENT DOCUMENTS

| | | | | |
|---|---|---|---|---|
| 2,865,290 A | | 12/1958 | Bonsper | |
| 3,176,617 A | | 4/1965 | Brafford | |
| 3,504,628 A | | 4/1970 | Pack et al. | |
| 4,691,638 A | * | 9/1987 | Meyer et al. | 102/434 |
| 5,069,137 A | * | 12/1991 | Martwick | 102/434 |
| 5,493,973 A | | 2/1996 | Brion et al. | |

FOREIGN PATENT DOCUMENTS

| | | |
|---|---|---|
| DE | 10 82 834 | 6/1960 |
| DE | 70 00 615 | 6/1970 |
| DE | 37 37 704 | 5/1989 |
| DE | 695 00 620 | 1/1998 |
| DE | 197 49 486 | 5/1999 |
| DE | 696 06 954 | 6/2000 |
| DE | 100 31 588 | 1/2002 |
| EP | 0 483 787 | 5/1992 |
| EP | 0775887 | 10/1996 |
| JP | 04 347500 | 12/1992 |
| JP | 82 122000 | 5/1996 |
| WO | WO 95/24605 | 3/1995 |

* cited by examiner

*Primary Examiner*—J. Woodrow Eldred
(74) *Attorney, Agent, or Firm*—Lucas & Mercanti, LLP; Klaus P. Stoffel

(57) ABSTRACT

The invention relates to a connecting mechanism for a multiple-part munition (1), for example for artillery charges. It is proposed that a multiple-part munition (1) be connected by means of a simple plug connection to at least two casing elements (2) which can be connected to one another and are arranged axially one behind the other, of a propellent-charge casing (10), with the casing elements (2) having a taper (3) and/or a corresponding opening (4) on their mutually facing end faces or tail faces, and the tapers (3) and/or the inner wall (7) of the openings (4) having projections (8) so that they can be connected to one another with a force fit by pushing them together.

10 Claims, 1 Drawing Sheet

MULTIPLE PART MUNITION

This is a U.S. national stage of application No. PCT/EP2006/004648, filed on May 17, 2006. Priority is claimed on that application and on the following application:

Country: Germany, Application No.: 10 2005 025 714.3 Filed: Jun. 4, 2005.

BACKGROUND OF THE INVENTION

The invention relates to a connection mechanism for a multiple-part munition, for example for artillery charges.

Artillery charges may be supplied as individual components, or assembled as multiple-part charge components, for a tube weapon. The munition comprises sleeve parts whose wall is in general produced from combustible material. The multiple-part structure and the desired amount of charge are produced by pushing the individual charges and sleeve elements together, and rotating them. The connected parts must remain well connected during transportation, removal from the storage or transportation container, and during the loading process.

One such connection type is known from DE 100 31 588 C2, in which the sleeve elements are provided with connection parts of a bayonet fitting on their mutually facing end faces.

In U.S. Pat. No. 3,504,628, the individual charges are also joined together by pushing them together and rotating them.

DE 695 00 620 T2 (EP 0 752 090 B1) discloses a plug connection between a propellant charge formed from two parts. The push-fit connection device comprises at least one pair of connection elements, each of which has a first connection element with a first sleeve and a second connection element which contains an axial protrusion. This protrusion produces the push-fit connection to the first sleeve, with complementary engagement, by pushing them together.

DE 696 06 954 T2 (EP 0 775 887 B1) describes a holding apparatus for a bag with explosive charge. In this case, the holding apparatus is itself supported by the case, which contains the loose or bundled propellant-charge powder in the interior. The holding apparatus in this case rests on the circumferential face around the case. A bead of the holding apparatus, as described in one exemplary embodiment, is used as the connection means between the holding apparatus and the case.

DE 197 49 486 A1 provides the connection between tube sections of combustible propellant charge sleeves via a non-detachable snap-action connection between the sections. The tube sections have four longitudinal cuts in the axial direction in the area of the connection, which are each arranged at an angle of 90° to one another.

A container composed of cartridge elements is also disclosed in DE 70 00 615 U. These cartridges have a taper on the closed faces, into which the respective next cartridge can be plugged, or detached from it, with the aid of wall extensions.

SUMMARY AND DESCRIPTION OF THE INVENTION

The invention is based on the object of providing a (modular) charge which can be split, by means of a simple connection mechanism which maintains a good connection during transportation, removal from the storage or transportation container and during the loading process.

The invention is based on the idea of producing the connection by means of a simple plug-in mechanism which has grids or projections at least on one charge element casing in the plug-in zone. The grids or projections are in this case relatively soft and flex in response to a predetermined definable pressure when the sleeve elements are being plugged together or disconnected. For this reason, the projections should have a different material density than the rest of the material. While the charge elements are being plugged together, the projections act on or engage in corresponding plug-in zones on the front and rear charge element.

The projections can on the one hand be provided on the outer tapered circumference of the propellant charge sleeve or on the inner wall of the sleeve in the area of the plug-in zone, in which case it is also possible to provide the projections on both geometries, as an alternative. The projections are then preferably not directly opposite one another but are offset with respect to one another, although this is not a condition. If, in contrast, the projections were to act on one another, then they could each be reduced by the height of the opposite projection, thus overall providing the necessary projection and ensuring the necessary holding force.

In one preferred embodiment, the openings which are required to displace moisture are produced by projections that are produced at the open end, which does not taper, on the pressing grid. These carry out the holding function on the plug-in zone, which is intended to be used later as the connection point.

In one development of the invention, the projections can be arranged in accordance with the required characteristics for tool design. This also makes it possible to define the holding force when joining them together, and the resistance during disconnection.

This type of connection ensures firm seating despite possible fluctuations and changes in the dimensions of the shaped parts that are produced, for example caused by tool wear. This allows the tools to be used for a longer time.

A multiple function can be achieved by adaptation to the shape, depth, length and number of these projections, that is to say variation of the grid profile. In addition to sufficiently good retention, this variation makes it possible to introduce additional charges in the charge elements. Furthermore, the holding force can be matched to the respective charge weight.

The projections may be a component of the sleeve, or else may be applied in a further method step.

In the case of multiple-part charge structures, the wall thickness is considerably reduced at the connection points or in the connection zone, thus making it possible to contribute to a reduction of material which does not burn completely in the charge area, but at least improves the residue behavior.

The amount of charge can therefore be changed by disconnection of the individual stages without any aids and in situ, at any time, without any effect or adverse effect on the plug-in capability and holding force.

BRIEF DESCRIPTION OF THE DRAWINGS

The invention will be explained in more detail using one exemplary embodiment and with reference to the drawing, in which.

DETAILED DESCRIPTION OF THE INVENTION

Figure 1:
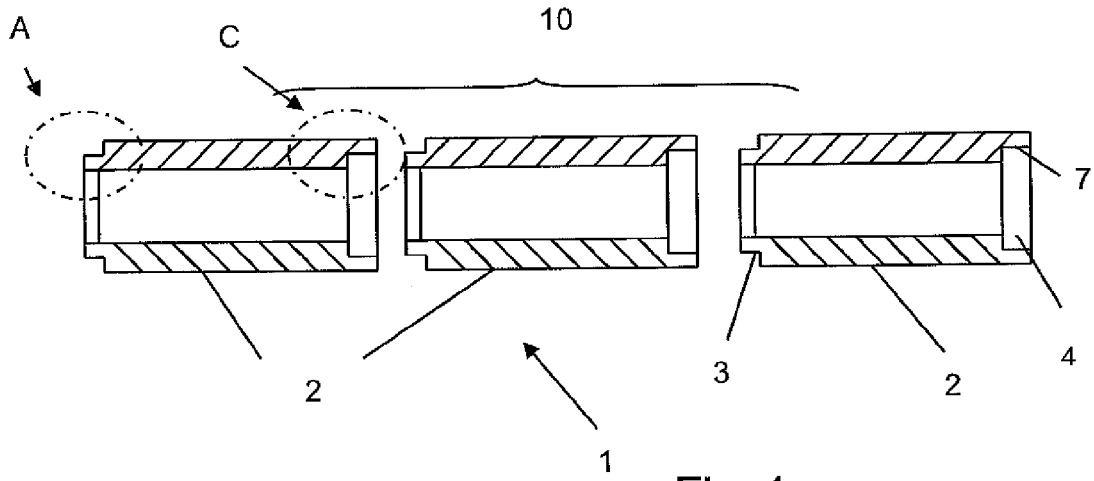
FIG. 1 shows sleeve parts of a multiple-part charge, in the form of a section.
Figure 1A:
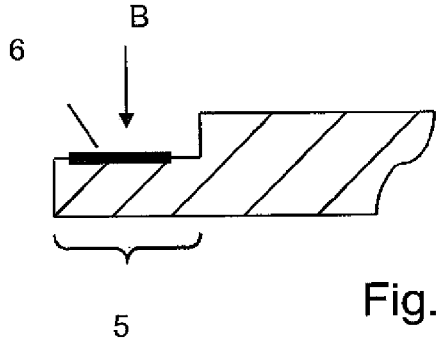
FIG. 1*a* shows an enlarged illustration of the detail A from FIG. 1.

FIG. 1 shows a multiple-part munition 1 which, inter alia, has at least two sleeve elements 2, which are arranged one behind the other and can be connected to one another, of a propellant charge sleeve 10. The sleeve elements 2 have tapers 3 circumferentially either on the end face or on the rear face, in which case openings 4 are then provided opposite one another on the end face or rear face so that either there is a taper on the end face and a projection at the opposite end, or vice versa. The sleeve elements 2 can each be plugged together by means of these two geometries. 5 denotes a plug-in or connection zone of the sleeve elements 2. As is illustrated in FIGS. 1*a* and 1*b*, the projections 6 are distributed on the circumferential face within the connection zone 5, whose material density is less than the rest of the material in the connection zone 5. The projections 6 are elongated and are aligned in the plug-in or connection direction.

When they are being plugged together, the projections 6 act on the inner wall 7 of the opening 4 of the previous or subsequent sleeve element 2. During this process, the projections 6 are pressed against the inner wall 7 and create the necessary connection force, and the necessary retention, by their natural elasticity.

Figure 1C:
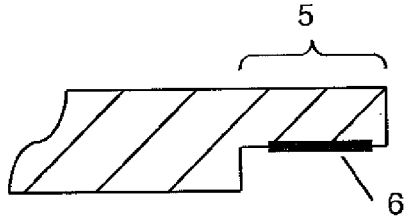
FIG. 1*c* shows an enlarged illustration of the detail C from FIG. 1, with a further variant.
Figure 1B:
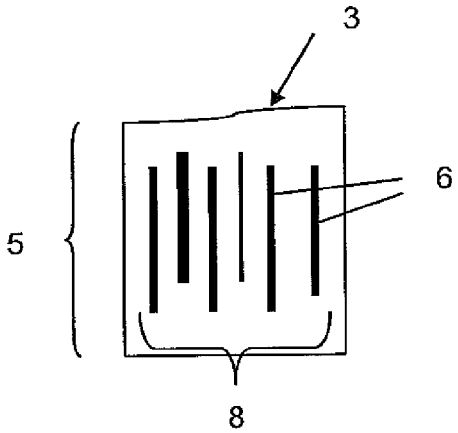
FIG. 1*b* shows a plan view in the direction B from FIG. 1*a*.
Figure 1D:
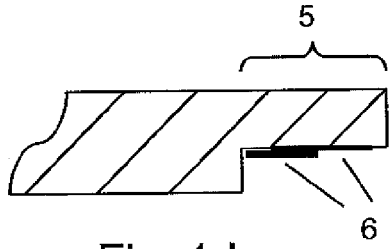
FIG. 1*d* is a view similar to FIG. 1*c* of a further variant.

In one preferred variant or embodiment, which is illustrated in FIG. 1*c*, the projections 6 or the grid profile 8 can also be incorporated in the inner wall 7 of the opening 4. Alternatively, a combination of both embodiments is possible. FIG. 1*d*shows an embodiment in which the shape and depth of the projection 6 is varied.

The pressure that needs to be applied to join the sleeve elements 2 together and to disconnect them is sufficiently low that the sleeves 2 can be disconnected or plugged together by hand without any additional aids, but maintains a good connection during transportation, removal from the storage or transportation container, and during the loading process.

The invention claimed is:

1. A multiple-part munition, comprising a propellant charge having at least two nearly identical sleeve elements, which are arranged axially behind one another and are connectable to one another, each of the sleeve elements having a first end face and a second end face, the first end face having a taper and the second end face having a corresponding appropriate opening, the first end face of one sleeve element facing a second end face of another sleeve element, and the tapers or an inner wall of the openings having projections arranged so that the sleeve elements are connected to one another with a force fit in a connection zone between the taper of one sleeve element and the opening of another sleeve element when pushed together, wherein the projections form a varied grid profile.

2. The multiple-part munition according to claim 1, wherein the projections are varied by shape, depth, length and number projections to form the varied grid profile.

3. The multiple-part munition according to claim 1, wherein the projections are arranged and introduced to confirm to tooling requirements for production of the projections.

4. The multiple-part munition according to claim 1, wherein the projections have a lower material density distributed on a circumferential face within The connection zone than a material density of a remainder of materials in the connection zone.

5. The multiple-part munition according to claim 2, wherein the grid profile is provided at least in a subarea of the connection area.

6. The multiple-pad munition according to claim 2, wherein the grid profile is provided at least in places on a circumferential face of the tapers or the inner wall.

7. The multiple-part munition according to claim 1, wherein the projections are applied to the taper and to the inner wall so as to be offset with respect to one another when the sleeve elements are pushed together.

8. The multiple-part munition according to claim 1, wherein the projections are applied to the taper and to the inner wall so as to act on one another, whereby each projection is reduced by a height of an opposite projection, so that a combination of necessary projections is created that provides a necessary holding force.

9. The multiple-part munition according to claim 1, wherein a wall thickness of the sleeve elements is considerably reduced in the connection area.

10. The multiple-part munition according to claim 1, wherein both the taper and the inner wall of the opening have projections.

* * * * *